US010011341B1

(12) United States Patent
Tuchscherer et al.

(10) Patent No.: US 10,011,341 B1
(45) Date of Patent: Jul. 3, 2018

(54) MARINE DRIVES HAVING EXHAUST SYSTEMS THAT DISCHARGE EXHAUST GAS THROUGH A GEARCASE HOUSING

(71) Applicant: Brunswick Corporation, Mettawa, IL (US)

(72) Inventors: John A. Tuchscherer, Oshkosh, WI (US); Josh S. Smith, Milwaukee, WI (US); Philip R. Walker, Oshkosh, WI (US); John O. Scherer, III, Oshkosh, WI (US)

(73) Assignee: Brunswick Corporation, Mettawa, IL (US)

( * ) Notice: Subject to any disclaimer, the term of this patent is extended or adjusted under 35 U.S.C. 154(b) by 0 days.

(21) Appl. No.: 15/901,269

(22) Filed: Feb. 21, 2018

Related U.S. Application Data

(63) Continuation of application No. 15/414,854, filed on Jan. 25, 2017, now Pat. No. 9,932,099.

(51) Int. Cl.
*B63H 20/26* (2006.01)
*B63H 1/18* (2006.01)
*B63H 20/32* (2006.01)

(52) U.S. Cl.
CPC ..... *B63H 20/26* (2013.01); *B63H 1/18* (2013.01); *B63H 20/32* (2013.01); *B63B 2758/00* (2013.01); *B63H 2020/323* (2013.01)

(58) Field of Classification Search
CPC ..... B63H 20/26; B63H 20/245
See application file for complete search history.

(56) References Cited

U.S. PATENT DOCUMENTS 2,082,059 A * 6/1937 Irgens ..... F01N 13/00 416/164
3,434,447 A * 3/1969 Christensen ..... B63H 1/28 114/67 R
3,745,964 A * 7/1973 Henrich ..... B63H 20/245 440/66
4,897,061 A * 1/1990 Koepsel ..... B63H 20/245 440/89 R
5,299,961 A * 4/1994 Okamoto ..... B63H 20/245 440/89 J
5,759,073 A * 6/1998 Sumino ..... B63H 1/28 440/66
5,807,151 A * 9/1998 Sumino ..... B63H 1/26 416/129
5,954,554 A * 9/1999 Bates ..... B63H 20/245 440/89 A (Continued)

*Primary Examiner* — Lars A Olson
*Assistant Examiner* — Jovon E Hayes
(74) *Attorney, Agent, or Firm* — Andrus Intellectual Property Law, LLP

(57) ABSTRACT

A marine drive has an internal combustion engine that rotates a propulsor shaft that is operatively coupled to a propulsor to impart a propulsive thrust in water. The marine drive has a gearcase housing having an upper portion above a lower portion, the lower portion supporting the propulsor shaft. An exhaust passage in the gearcase housing is configured to convey exhaust gas from the internal combustion engine. An exhaust outlet on the upper portion of the gearcase housing is configured to discharge the exhaust gas from the exhaust passage to the water. The exhaust outlet faces the propulsor so that the exhaust gas is discharged into the water and towards the propulsor so as to aerate the water encountered by the propulsor.

20 Claims, 9 Drawing Sheets

(56) References Cited

U.S. PATENT DOCUMENTS

| | | | | |
|---|---|---|---|---|
| 6,010,380 | A * | 1/2000 | Wollard | B63H 20/245<br>416/93 A |
| 7,387,556 | B1 * | 6/2008 | Davis | B63H 20/26<br>440/112 |
| 7,762,772 | B1 * | 7/2010 | Alby | B63H 1/20<br>416/244 B |

* cited by examiner

MARINE DRIVES HAVING EXHAUST SYSTEMS THAT DISCHARGE EXHAUST GAS THROUGH A GEARCASE HOUSING

CROSS-REFERENCE TO RELATED APPLICATION

This present application is a continuation application of U.S. patent application Ser. No. 15/414,854, filed Jan. 25, 2017, which is hereby incorporated by reference in entirety.

FIELD

The present disclosure relates to marine propulsion devices, and particularly to marine drives having exhaust systems that discharge exhaust gas through a gearcase housing.

BACKGROUND

The following U.S. Patents are incorporated herein by reference in entirety.

U.S. Pat. No. 7,387,556 discloses an exhaust system for a marine propulsion device, which directs a flow of exhaust gas from an engine located within the marine vessel, and preferably within a bilge portion of the marine vessel, through a housing which is rotatable and supported below the marine vessel. The exhaust passageway extends through an interface between stationary and rotatable portions of the marine propulsion device, through a cavity formed in the housing, and outwardly through hubs of pusher propellers to conduct the exhaust gas away from the propellers without causing a deleterious condition referred to as ventilation.

U.S. Pat. No. 5,954,554 discloses an outboard drive that involves an improved exhaust system that increases the reverse thrust produced by the outboard drive. The exhaust system includes a first exhaust passage and a second exhaust passage that stems from a first exhaust passage. A flow control device operates within the exhaust system to control exhaust gas flow through second passage depending upon the drive condition (either forward or reverse) of the outboard drive. The flow control device permits exhaust gas flow through the second passage when the outboard drive operates in reverse, while inhibiting exhaust gas flow through the second passage when the outboard drive operates under a forward drive condition. In this manner, the improved exhaust system reduces exhaust gas back pressure and thrust degradation due to exhaust gas entrainment in the propeller when the outboard drive operates in reverse.

U.S. Pat. No. 5,759,073 discloses a propulsion system for a marine drive, which includes a pair of counter-rotating propellers, and provides improved acceleration from idle or low speeds. Engine exhaust from an engine which powers the marine drive is conveyed to the water about each of the propellers. The exhaust gases aerate the water about each propeller to reduce drag resistance on each propeller. Several embodiments of the propulsion system are disclosed which convey the exhaust gases to both propellers for this purpose.

U.S. Pat. No. 5,299,961 discloses a marine propulsion unit that includes a cavitation cavity defining a supplemental exhaust gas passage terminating at an exhaust outlet port which is adapted to be opened and closed by a normally closed flapper control valve member. The exhaust outlet port includes lateral sidewalls and the flapper control valve member includes a fixed portion secured to one of the lateral sidewalls and a cantilevered portion that extends across the exhaust outlet port. The cantilevered portion is adapted to flex relative to the fixed portion so as to open and close the exhaust outlet port in response to dynamic forces acting on the control valve member during operation of the watercraft. A stopper plate is provided to limit the deflection of the cantilevered portion of control valve member. The cantilevered portion of the control valve member is further provided with a fin which projects into the water during operation of the watercraft so that the dynamic pressure of the water acts against the fin the supplement the dynamic pressure exerted on the control valve member by the exhaust gas pressure from within the supplemental exhaust passage and to cause the control valve to open. When the watercraft is stopped, running at low speeds, decelerating or immediately after planning, the control valve will assume a position in which it closes the supplemental exhaust outlet port to reduce exhaust noise.

SUMMARY

This Summary is provided to introduce a selection of concepts that are further described below in the Detailed Description. This Summary is not intended to identify key or essential features of the claimed subject matter, nor is it intended to be used as an aid in limiting the scope of the claimed subject matter.

A marine drive has an internal combustion engine that rotates a propulsor shaft that is operatively coupled to a propulsor to impart a propulsive thrust in water. The marine drive has a gearcase housing having an upper portion above a lower portion, the lower portion supporting the propulsor shaft. An exhaust passage in the gearcase housing is configured to convey exhaust gas from the internal combustion engine. An exhaust outlet on the upper portion of the gearcase housing is configured to discharge the exhaust gas from the exhaust passage to the water. The exhaust outlet faces the propulsor so that the exhaust gas is discharged into the water and towards the propulsor so as to aerate the water encountered by the propulsor.

Another aspect of the present disclosure relates to a marine drive having an internal combustion engine that rotates a propulsor shaft that is operatively coupled to a propulsor to impart a propulsive thrust in water. The marine drive has a gearcase housing having an upper portion above a lower portion, the lower portion supporting the propulsor shaft. The upper portion has a vertically extending strut with a trailing edge and an anti-cavitation plate horizontally extending from the strut. The anti-cavitation plate has a lower surface. An exhaust passage in the gearcase housing is configured to convey exhaust gas from the internal combustion engine. An exhaust outlet has a plurality of openings located on the trailing edge of the strut and on the lower surface of the anti-cavitation plate. The exhaust outlet is configured to discharge the exhaust gas from the exhaust passage to the water. A strut control valve and a plate control valve are each positionable into and between an open position and a closed position. The exhaust gas is allowed to pass through the plurality of openings located on the trailing edge only when then strut control valve is in an open position, and wherein the exhaust gas is allowed to pass through the plurality of openings located on the lower surface only when then plate control valve is in an open position. The plurality of openings face the propulsor so that the exhaust gas is discharged into the water and towards the propulsor so as to aerate the water encountered by the propulsor.

Another aspect of the present disclosure relates to a method of operating a marine drive having an internal combustion engine that rotates a propulsor shaft operatively coupled to a propulsor to impart a propulsive thrust in water. The method includes controlling flow of exhaust gas from the internal combustion via an exhaust outlet in an upper portion of a gearcase housing. The upper portion is above a lower portion of the gearcase housing that supports the propulsor shaft. The exhaust outlet is configured to discharge the exhaust gas from the exhaust passage to the water. The exhaust outlet faces the propulsor so that the exhaust gas is discharged into the water and towards the propulsor so as to aerate the water encountered by the propulsor.

BRIEF DESCRIPTION OF THE DRAWINGS

The present disclosure is described with reference to the following Figures. The same numbers are used throughout the Figures to reference like features and like components.

DETAILED DESCRIPTION OF THE DRAWINGS

In the present description, certain terms have been used for brevity, clarity and understanding. No unnecessary limitations are to be inferred therefrom beyond the requirement of the prior art because such terms are used for descriptive purposes only and are intended to be broadly construed.

Figure 1:
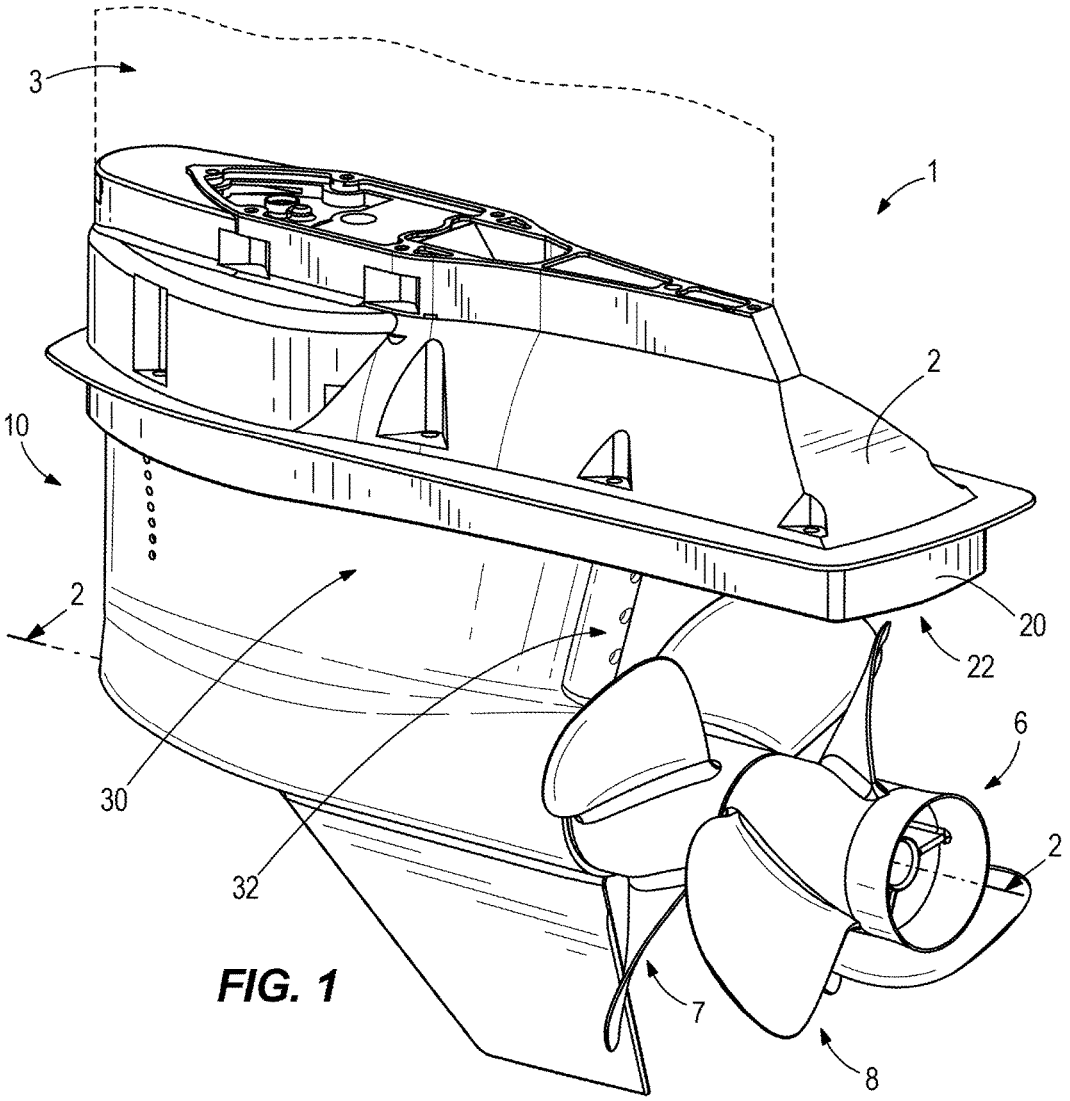
FIG. 1 is a perspective view of a marine drive in accordance with the present disclosure.

FIG. 1 shows a marine drive 1 in accordance with the present disclosure. The marine drive 1 includes a midsection 2 that is operatively coupled to an internal combustion engine 3. A gearcase housing 10 is operatively coupled to the midsection 2. In the embodiment shown, the gearcase housing 10 includes a vertically extending strut 30 having a trailing edge 32 and an anti-cavitation plate 20 that extends from the trailing edge 32 of the strut 30. The anti-cavitation plate has a lower surface 22, which will be discussed in further detail below. The marine drive 1 further includes one or more propulsors 6, shown here as a forward propeller 7 and an aftward propeller 8.

Figure 2:
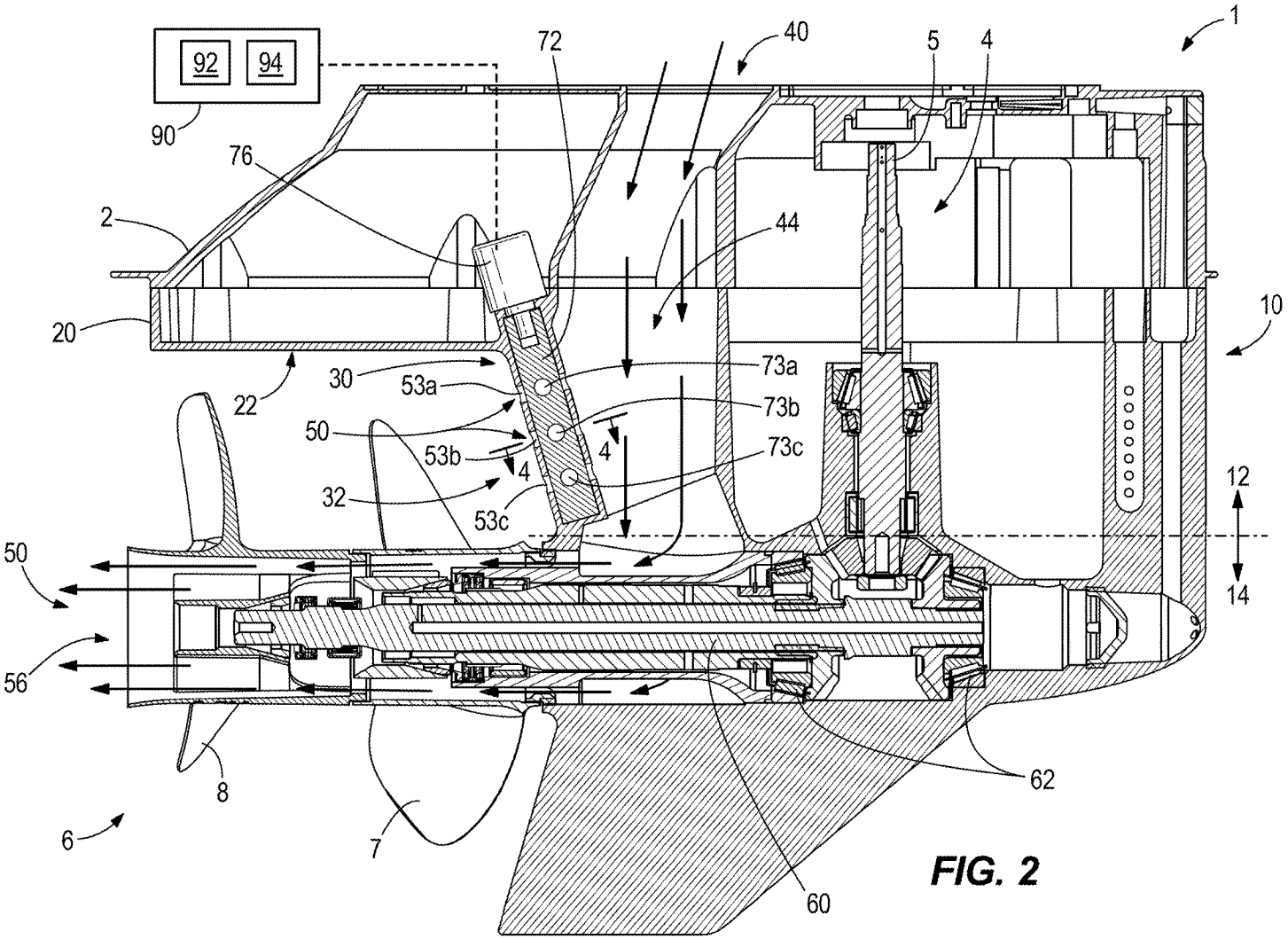
FIG. 2 is a section view taken along the line 2-2 from FIG. 1, showing the marine drive in a first operating condition.

FIG. 2 shows a sectional view of marine drive 1 from FIG. 1. In the embodiment shown, the gearcase housing 10 includes an upper portion 12 and a lower portion 14, whereby the lower portion 14 supports at least one propulsor shaft 60 that is operatively coupled to one or more propulsors 6 to impart a propulsive thrust in the water. In the embodiment shown, the propulsors 6 include a forward propeller 7 and aftward propeller 8. The internal combustion engine 3 (shown in FIG. 1) is operatively coupled to a transmission 4, which selectively causes rotation of the transmission output shaft 5. The transmission output shaft 5 is operatively coupled to the propulsor shaft 60 through the angle gears 62. In this regard, the internal combustion engine 3 causes the propulsor shaft 60 to rotate, causing the forward propeller 7 and the aftward propeller 8 to impart propulsive thrusts in the water.

The arrows shown in the Figures represent the flow of an exhaust gas from the internal combustion engine 3, which is conveyed from the internal combustion engine 3 to an exhaust passage 40. In the embodiment shown, the exhaust gas is conveyed from the exhaust passage 40 to a lower passage 44 before being discharged in the water through the hub opening 56 at the aft end of the aftward propeller 8. This is also referred to as being a "through-prop" exhaust system.

The present inventors have identified that in certain configurations of marine drives, including those having two counter-rotating propellers, there is insufficient space surrounding the propulsor shaft 60 for the entirety of the exhaust gas to be discharged through the hub opening 56. Specifically, in a typical marine drive having counter-rotating propellers, the propulsor shaft 60 comprises two propulsor shafts, which requires additional space within the gearcase housing 10. There is also a competing interest in minimizing the size of the gearcase housing 10 to thereby minimize the drag that it creates. Therefore, adding a second propulsor shaft within the already limited open area of the gearcase housing 10 further diminishes the ability to sufficiently discharge the exhaust gas through the hub opening 56.

The present inventors have also identified that marine drives known in the art having poor acceleration performance, poor cruising performance, or mediocre performance from compromising on acceleration and cruising, due to conflicting needs in propeller size. Poor acceleration can be caused by using a propeller having too large of a pitch and/or diameter, which causes lugging of the engine in the portion of the torque curve with lower torque. However, a propeller with a large pitch and/or diameter often provides the highest top speed and is desirable for cruising. Performance under these conditions is effectively opposite for a propeller having a small pitch and/or diameter. In this regard, acceleration performance can be enhanced by selectively aerating the water encountered by a propeller, effectively reducing the volume of water grabbed by the propulsors 6. This selective aeration can allow the marine drive 1 to be operated within the desired torque curve by controlling the discharge of exhaust gas into the water, which is discussed further below.

Accordingly, the present inventors have developed the disclosed marine drive 1 and methods to convey exhaust gas from the internal combustion engine 3 through exhaust outlets 50 in addition to, or instead of, through the hub opening 56. In the embodiment shown, a series of strut openings 53*a-c* are defined in the trailing edge 32 of the strut 30. These openings span between an upper end 34 and a lower end 36 of the trailing edge 32 (shown in FIG. 3). In addition, this embodiment includes a control valve, shown here as a spool valve, which is referred to as the strut control valve 72. The strut control valve 72 is rotatably actuated by an electronic actuator 76, which causes a plurality of passages 73*a-c* within the strut control valve 72 to align with the strut openings 53*a-c*. Alignment of the plurality of passages 73*a-c* and the strut openings 53*a-c* allows the exhaust gas in the lower passage 44 to discharge into the water. It should be known that while the strut control valve 72 is shown as a rotating spool valve, other types of valves may also be used, including but not limited to sliding valves, flappers, and others valves known in the art.

The electronic actuator 76 is operatively coupled to a control module 90 to control actuation of the strut control valve 72. In the embodiment shown, the control module 90 further comprises a processing module 92 and a non-transitory memory 94. The processing module 92 is configured to execute a program stored within the non-transitory memory 94 to operate the electronic actuator 76 (and/or electronic actuator 78, as discussed below) in accordance with the operating conditions of the marine drive 1 and/or operator commands. While the processing module 92 and the non-transitory memory 94 are shown to be substantially integrated into the control module 90, one of ordinary skill in the art would recognize that these components may be contained separately, while remaining operatively connected. Similarly, the dashed line between the control module 90 and the strut control valve 72 depicts communication therebetween and does not indicate a required wiring schematic.

Figure 3:
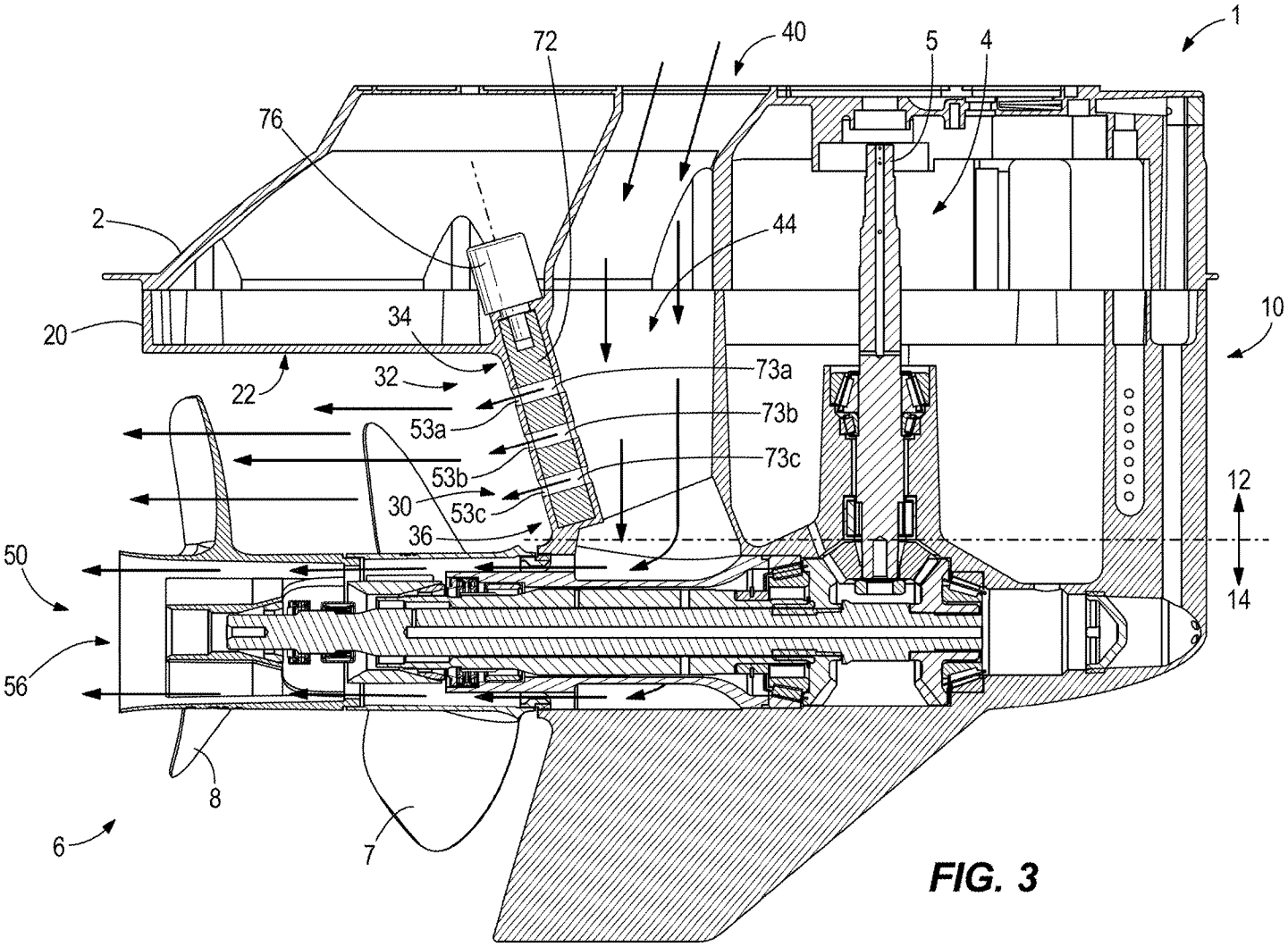
FIG. 3 shows the marine drive of FIG. 2 in a second operating condition.

In the configuration depicted in FIG. 2, the strut control valve 72 is shown in a closed position, preventing exhaust gas from passing through the strut openings 53*a-c*. As such, the entirety of the exhaust gas is discharged through the hub opening 56. In contrast, FIG. 3 shows the same marine drive 1 as FIG. 2, but in a configuration whereby the strut control valve 72 is in an open position that allows exhaust gas to pass from the lower passage 44 through the strut openings 53*a-c* to be discharged into the water. The present configuration shows some portion of the exhaust gas being discharged through the strut openings 53*a-c* and another portion through the hub opening 56. However, opening the strut control valve 72 may also at least partially close the hub opening 56, either by the strut control valve 72 itself or using a hub control valve (not shown). The present inventors have identified benefits to leaving the hub opening 56 at least partially open. In particular, the exhaust gas fills in the low pressure area behind the propulsors 6, which reduces drag and the pumping work required by the internal combustion engine 3 during the exhaust stroke of operation.

As shown in FIG. 3, when the marine drive 1 is operated in a forward gear, the strut control valve 72 is in an open position to allow the exhaust gas to discharge into the water through the strut openings 53*a-c*, directed towards the propulsors 6. In the configuration shown, the exhaust gas is discharge towards both the forward propeller 7 and the aftward propeller 8 so as to aerate the water encountered by each of the propulsors 6. In certain embodiments it is further advantageous for the strut control valve 72 to be in the open position when the marine drive 1 is operated in a reverse gear. Specifically, the exhaust gas discharged through the hub opening 56, as well as plate openings 55*a-c* (discussed below) would aerate the water encountered by the propulsors 6, whereas the exhaust gas discharged through strut openings 53*a-c* would not. In this regard, certain embodiments have improved performance while operated in a reverse gear by minimizing or altogether eliminating the discharge of gas through the hub opening 56 and plate openings 55*a-c*.

Figure 4:
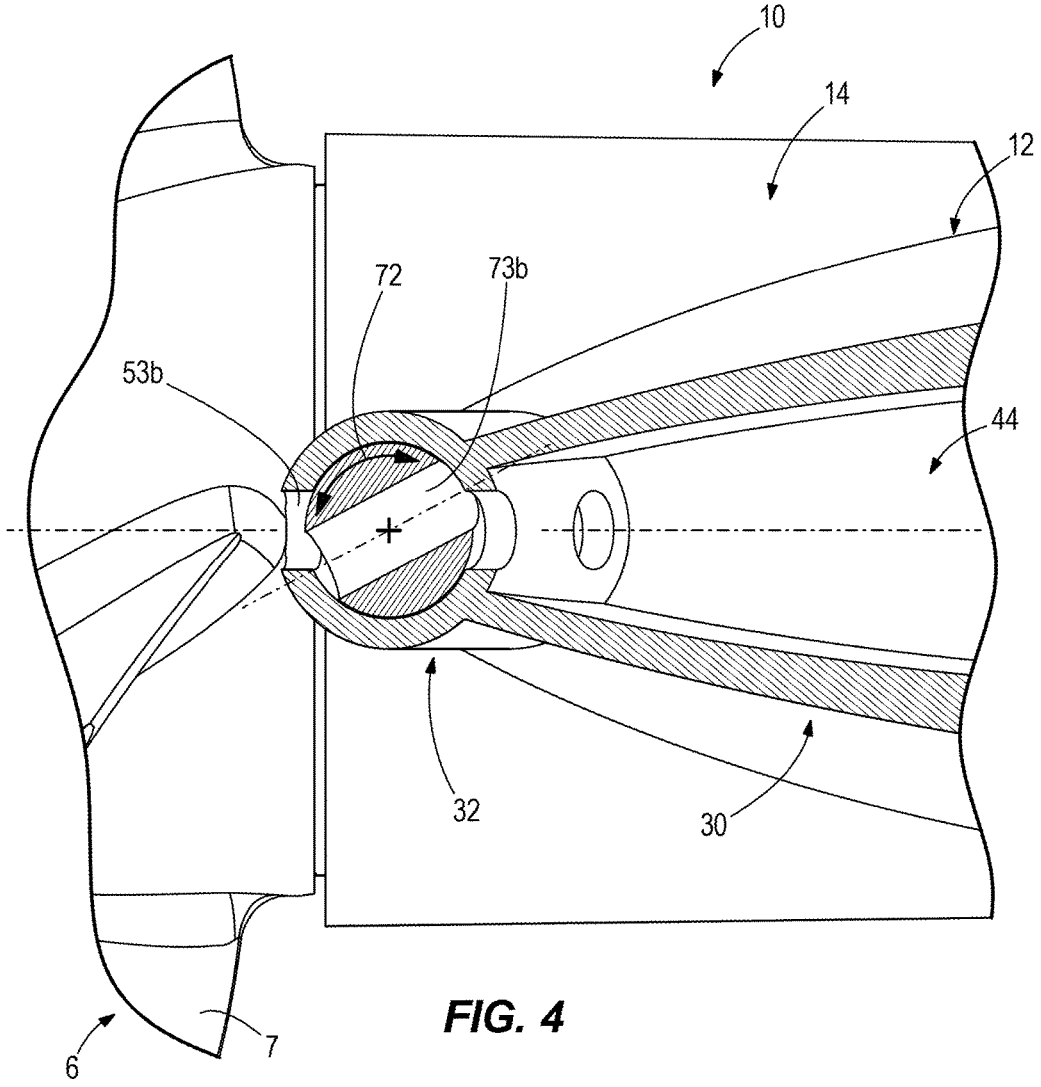
FIG. 4 is a section view taken along the line 4-4 from FIG. 2.

FIG. 4 shows a top-down sectional view of the marine drive 1 taken from line 4-4 in FIG. 2. As shown, the strut control valve 72 is partially rotated, corresponding to being in a partially open position. Accordingly, in the present configuration, some portion of exhaust gas would be discharged from the lower passage 44 into the water through the passage 73*b* and strut opening 53*b*.

Figure 5:
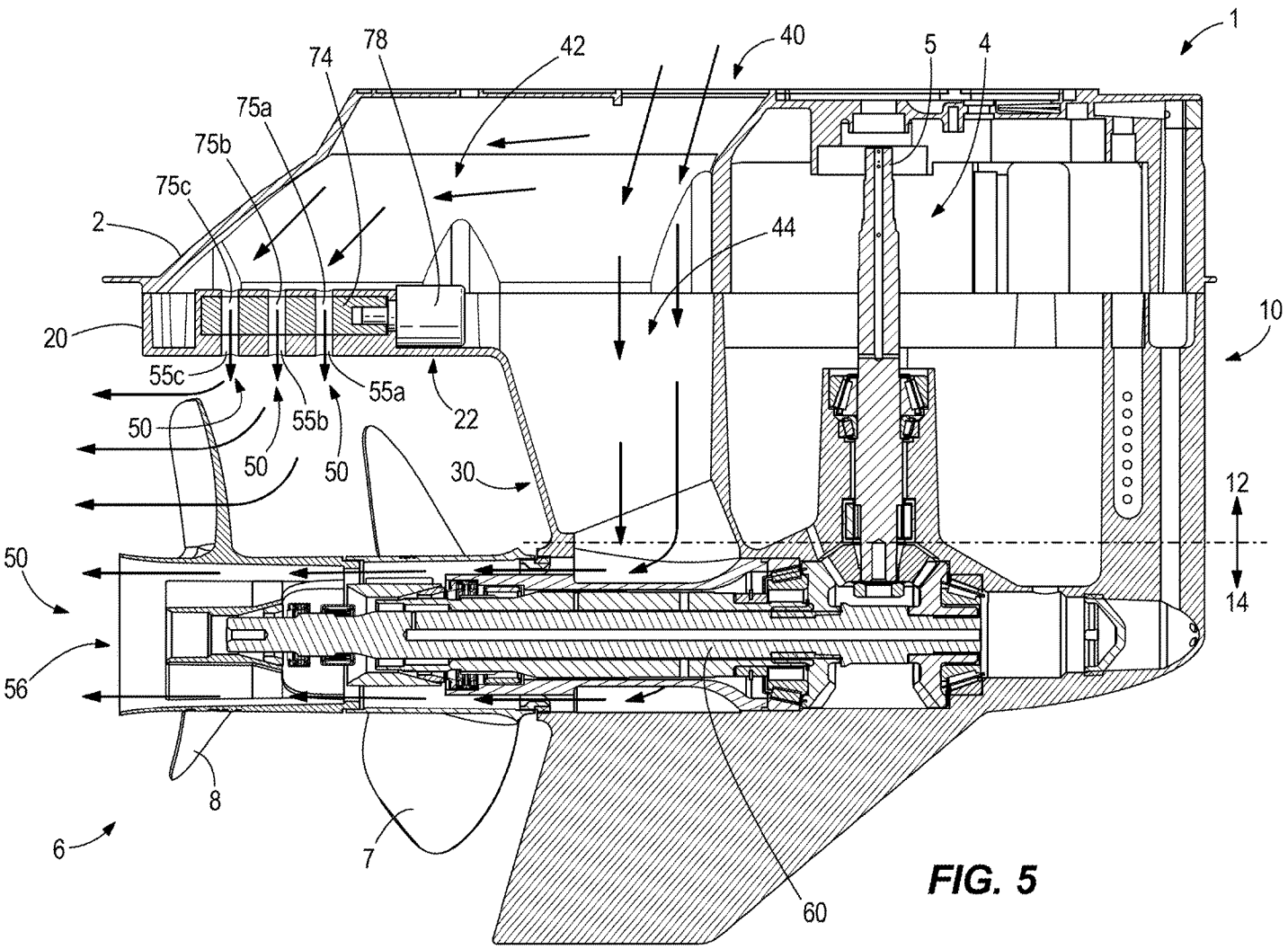
FIGS. 5-9 are sectional views taken along the line 2-2 in FIG. 1 showing different embodiments of the marine drive in accordance with the present disclosure.

FIG. 5 shows an alternate embodiment of the present disclosure, whereby exhaust gas is discharged from a plurality of plate openings 55*a-c* defined in the lower surface 22 of the anti-cavitation plate 20. By discharging the exhaust gas through the lower surface 22 rather than through the aft end of the anti-cavitation plate 20, noise emissions are reduced by discharging below the water line. In a similar manner to that previously described, the exhaust gas is conveyed from the exhaust passage 40 through an upper passage 42 before exiting through the plate openings 55*a-c*. Additionally, a plate control valve 74 actuated by an electronic actuator 78 causes a plurality of passages 75*a-c* to rotate into, out of, and between alignment with the plate openings 55*a-c*. While not expressly shown in the Figures, the electronic actuator 78 is controlled by the control module 90 in the same manner previously described for the electronic actuator 76.

The plate control valve 74 is actuated to either allow or prevent the discharge of exhaust gas into the water through the plate openings 55*a-c*. In the configuration shown, the plate openings 55*a-c* discharge the exhaust gas towards the propulsors 6, but in contrast to the strut openings 53*a-c* shown in FIG. 3, discharges the gas substantially between the forward propeller 7 and the aftward propeller 8. In this regard, it should be recognized that the present configuration discharges exhaust gas to aerate only the aftward propeller 8 when the marine drive 1 is operated in a forward gear, and aerate only the forward propeller 7 when the marine drive 1 is operated in a reverse gear.

Figure 6:
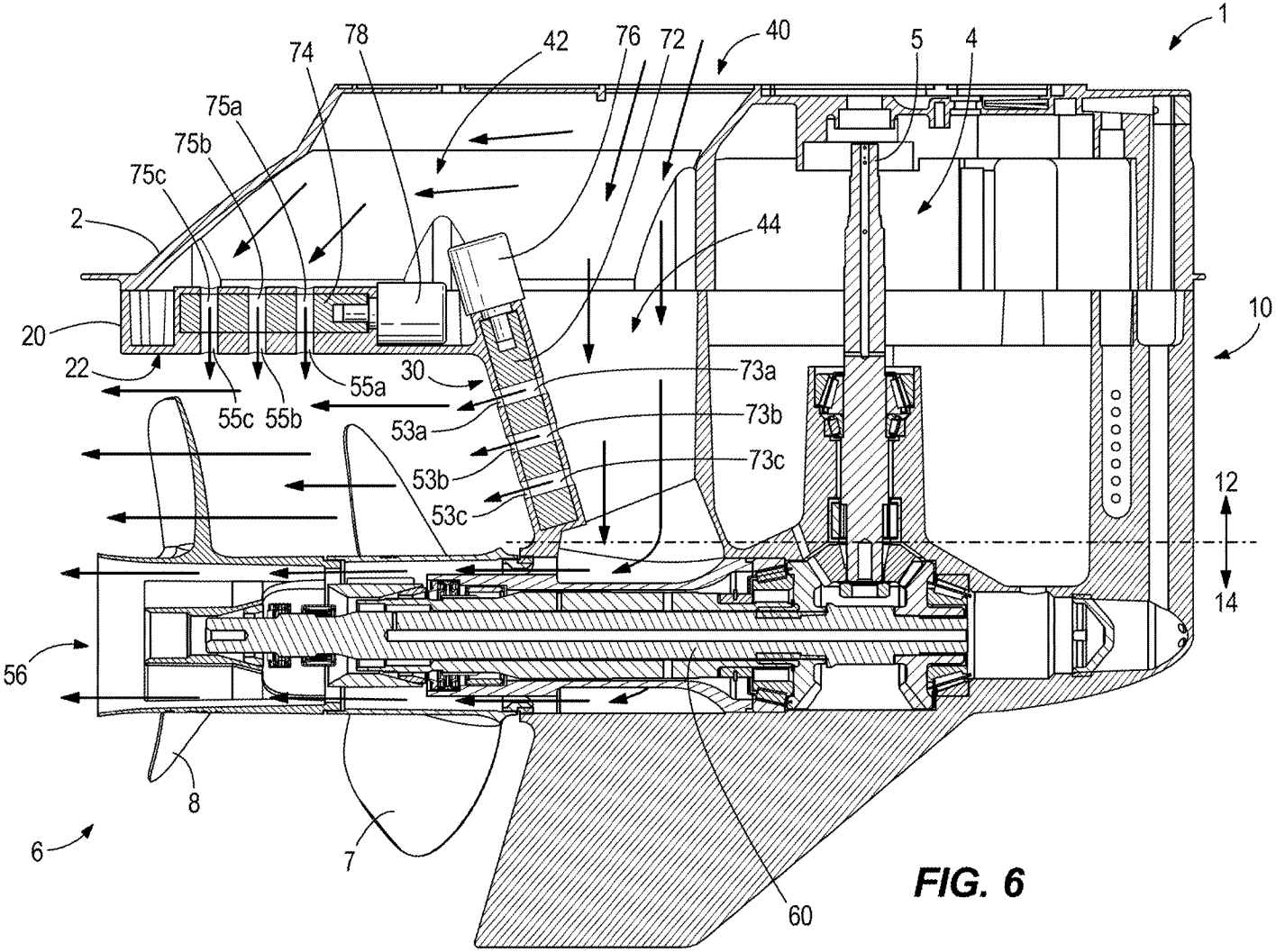

FIG. 6 shows an embodiment containing both strut openings 53*a-c* in the strut 30 and plate openings 55*a-c* in the anti-cavitation plate 20. The strut control valve 72 is actuated by the electronic actuator 76 and the plate control valve 74 is actuated by the electronic actuator 78 as previously described. In this configuration, the control module 90 may cause, either in sync or independently, the strut control valve 72 and the plate control valve 74 to be in an open position, closed position, or partially open position. It should be noted that operating in sync does not require the strut control valve 72 and the plate control valve 74 to be in the same position, but merely indicates controlling one with respect to the other. Specific configurations for the strut control valve 72 and the plate control valve 74 for various operating conditions of the marine drive 1 are described further below.

Figure 7:
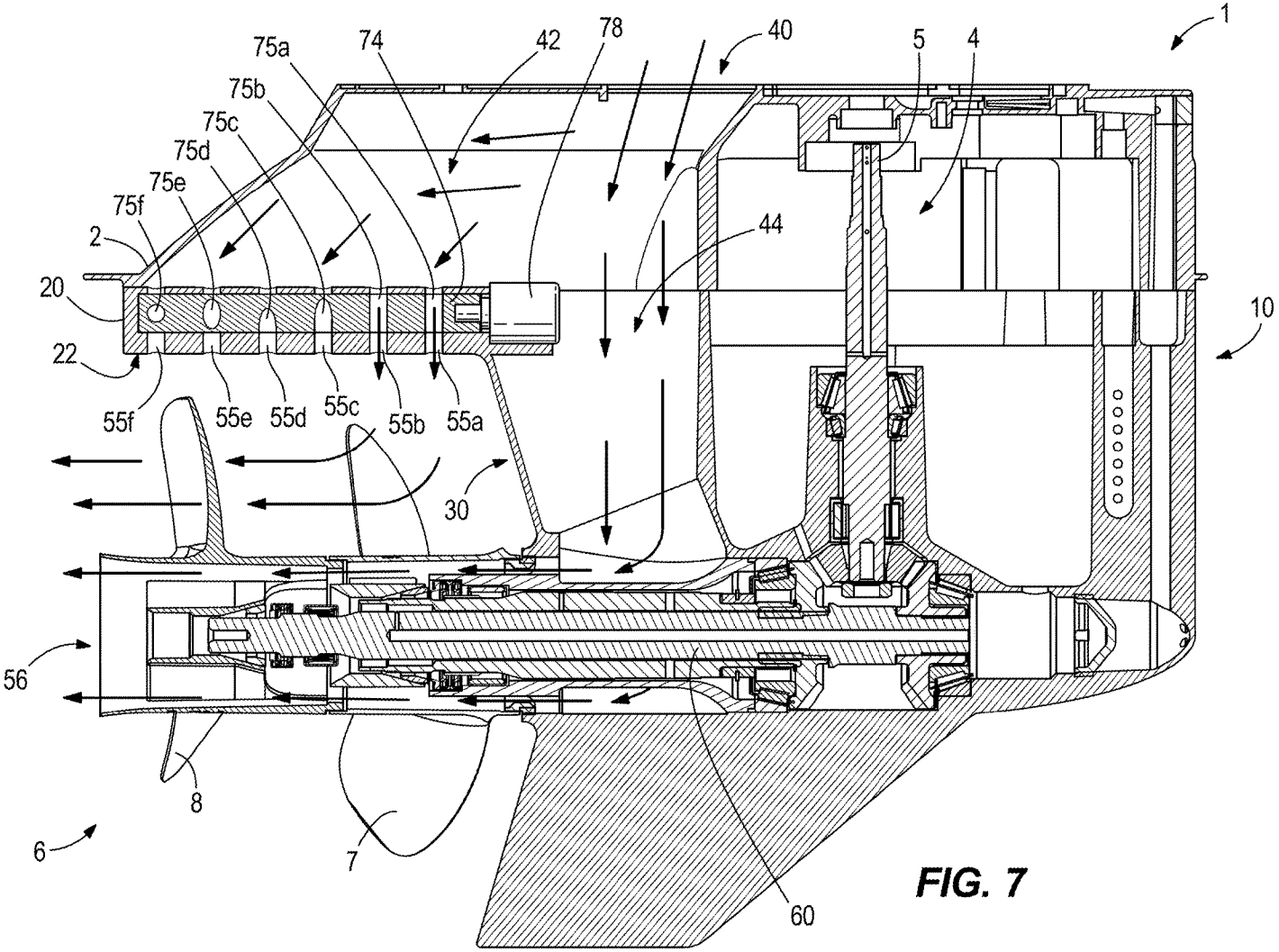

FIG. 7 discloses an embodiment of the marine drive 1 similar to that shown in FIG. 5, but whereby the plate control valve 74 has passages 75*a-f* corresponding to the plate openings 55*a-f* in the lower surface 22 of the anti-cavitation plate 20. As shown, plate opening 55*a* is directed forward of the forward propeller 7, plate opening 55*b* is directed substantially above the forward propeller 7, plate openings 55*c-d* are directed between the forward propeller 7 and the aftward propeller 8, plate opening 55*e* is directed substantially above the aftward propeller 8, and plate opening 55*f* is directed substantially aft of the aftward propeller 8. In addition, the passages 75*a-f* are shown to be axially-distributed about the axis of the plate control valve 74 such that the passages 75*a-f* do not all align with the plate openings 55*a-f* at the same rotational position of the plate control valve 74. Specifically, in the embodiment shown, the plate control valve 74 has been rotated by the electronic actuator 78 such that only the passages 75*a-b* are aligned with the plate openings (specifically, 55*a-b*). In this configuration, passages 75*c-f* are not aligned to the plate openings 55*c-f* and exhaust gas is only allowed to be discharged from the upper passage 42 through the plate openings 55*a-b*. It should be apparent that other rotational positions of the plate control valve 74 would result in the opening, closing, or partially-opening of the plate control valve 74 through alignment of the passages 75*a-f* and plate openings 55*a-f*. In this regard, exhaust gas may selectively be discharged forward of the forward propeller 7, directly above the forward propeller 7, between the forward propeller 7 and the aftward propeller 8, directly above the aftward propeller 8, or aft of the aftward propeller 8.

Figure 8:
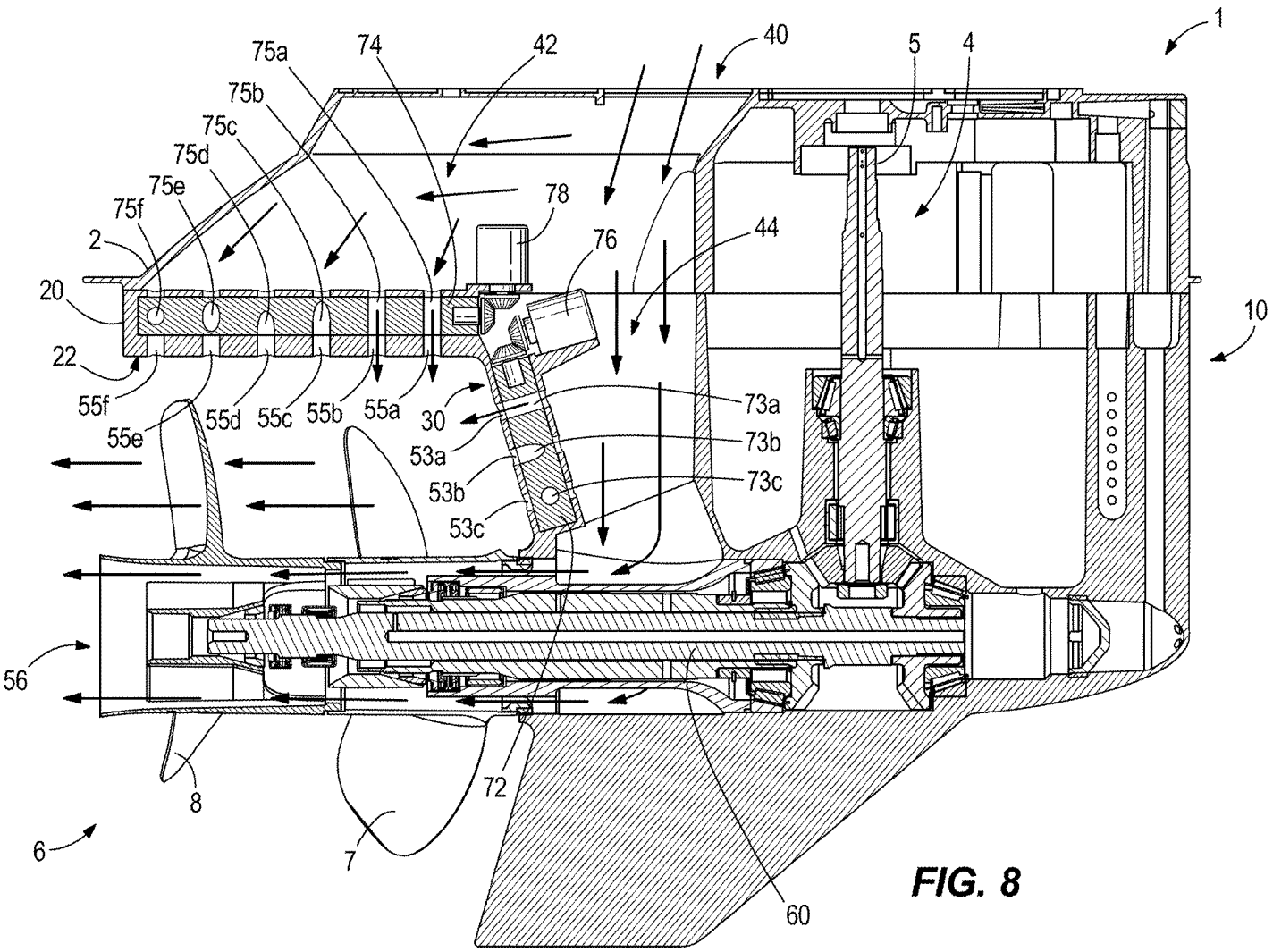

In the embodiment shown in FIG. 8, the same configuration of the plate control valve 74 is provided as shown in FIG. 7, but further includes the incorporation of a strut control valve 72. In the configuration shown, the passages 73*a-c* of the strut control valve 72 are axially-distributed in a similar manner as that described above for the plate control valve 74 of FIG. 7. In this regard, the strut control valve 72 can selectively discharge exhaust gas towards the tips of the forward propeller 7 via strut opening 53*a*, towards the base of the forward propeller 7 via strut opening 53*c*, or towards the middle of the forward propeller 7 via strut opening 53*b*.

Due to the elongation of the plate control valve 74, in contrast to the configuration shown in FIG. 6, angled gears are used to operatively couple the electronic actuator 76 to the strut control valve 72 and the electronic actuator 78 to the plate control valve within the allotted space. It should be recognized that other mechanisms for positioning the electronic actuator 76 and the electronic actuator 78 are anticipated by the present disclosure, including but not limited to belts, gears, and the like. Likewise, alternate configurations are anticipated for operating the strut control valve 72 and the plate control valve 74 when either comprises something other than a spool valves, such as a sliding valve, moving flap, or other means for opening, closing, or partially-opening the passages 73*a-c* and 75*a-f*, respectively.

Figure 9:
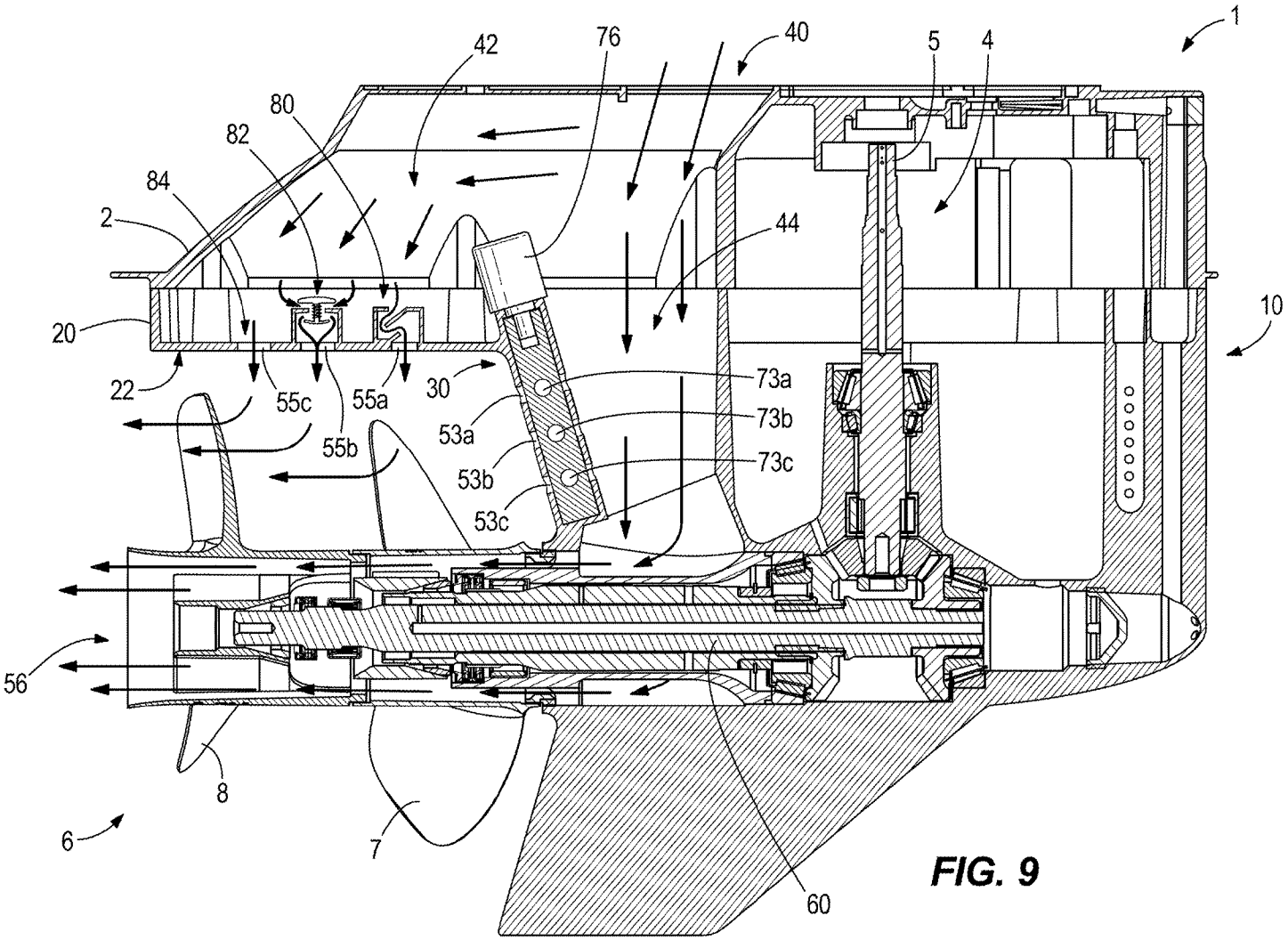

While the previously disclosed embodiments have principally incorporated actively controlled control valves, namely, the strut control valve 72 and/or the plate control valve 74, passive valves and/or static openings may also be used in conjunction with, or in place of, the actively controlled valves. The embodiment shown in FIG. 9 includes a strut control valve 72 as previously discussed, but further includes a reed valve 80, a poppet valve 82, and an opening 84 in communication with the plate openings 55*a-c* in the lower surface 22 of the anti-cavitation plate 20. As shown, the reed valve 80 is a flapper-style valve that constitutes a passive control valve actuated by a pressure differential between the pressure in the upper passage 42 and the pressure of the water at the plate opening 55*a*. The poppet valve 82 operates similarly to the reed valve 80, once again providing a passive control valve that is actuated by pressure differential between the exhaust passage and the water. In contrast, the opening 84, which can be metered or non-metered, provides a static passage by which the exhaust gas may discharge from the upper passage 42 through the plate opening 55*c* into the water.

In the configuration shown, exhaust gas is allowed to discharge from the upper passage 42 into the water through the reed valve 80 and the poppet valve 82 when the pressure in the upper passage 42 meet or exceed the pressure differential between the exhaust passage and the water. In contrast, when the pressure in the upper passage 42 does not meet or exceeds the pressure differential between the exhaust passage and the water, the reed valve 80 and the poppet valve 82 are closed to prevent exhaust gas from discharging into the water through the plate openings 55*a-b*. In either case, the opening 84 remains open and allows the exhaust gas to discharge through the plate opening 55*c*. As previously discussed, the reed valve 80, poppet valve 82, and opening 84 may operate independently of the strut control valve. However, the actuation of strut control valve 72 may create a difference in the pressure differential seen at the reed valve 80 and the poppet valve 82 to thereby influence the opening, closing, or partial-opening of the reed valve 80 and the poppet valve 82. It should be recognized different numbers and configurations of these passive valves and openings may be used, which may be used with the lower surface 22 of the anti-cavitation plate and/or the trailing edge 32 of the strut 30.

The present inventors have identified through experimentation and development that selectively allowing or preventing exhaust gas to discharge through the strut openings 53*a-c*, the plate openings 55*a-f*, and the hub opening 56 provides beneficial improvements to the operation of the marine drive 1 in various states of operation. Referring back to FIG. 8 for the purpose of demonstration, the present inventors have found that allowing gas to discharge through the strut 30 or the lower surface 22 of the anti-cavitation plate 20 provides benefits to the performance of the marine drive 1 when the marine drive 1 is operating in forward gear and accelerating. Specifically, the discharge of exhaust gas forward of both the forward propeller 7 and the aftward propeller 8 aerates the water encountered by the forward propeller 7 and the aftward propeller 8. By aerating this water, the forward propeller 7 and the aftward propeller 8 require less torque for a given speed (RPM), or are able to achieve a higher RPM for a given torque. When the forward propeller 7 and the aftward propeller 8 are rigidly coupled to the internal combustion engine 3 (i.e., there is no driveline slip), this aeration allows the internal combustion engine 3 to operate at a higher RPM, at which it is capable of greater torque output. The present inventors have found that the positive effect of the increased torque output outweighs the negative effect of reduced propeller efficiency caused by aerating the water, resulting in improved acceleration performance.

Accordingly, the presently disclosed marine drive 1 and methods provide advantages to the compromises required of marine drives known in the art. Generally, a large propeller is desirable for performance at cruising speeds, such as a 12-inch diameter propeller for a 350-horsepower engine at 60 miles per hour. In other configurations, the optimal propeller for cruising may have a diameter of 15 inches of more. However, this diameter is too large to permit high acceleration performance, whereby too much water is grabbed by the propeller blades to allow the propeller to rotate at an optimal RPM. Likewise, while a small diameter propeller performs better during acceleration, a small diameter propeller cannot hold the thrust required for optimum cruise performance. The present inventors have also identified that having a propeller with too small of a diameter generally provides poor reverse thrust.

The presently disclosed marine drive 1 is configurable such that the control module 90 discharges exhaust gas to aerate the water encountered by the propulsors 6 to attain optimal cruising and accelerating performance. In one embodiment, exhaust gas is discharged towards the propulsors 6 only during acceleration, causing the desired higher RPM. In contrast, exhaust gas is prevented from being discharging towards the propulsors 6 when the marine drive 1 is cruising.

As previously discussed, additional benefits are provided by targeted aeration of the forward propeller 7 and/or the aftward propeller 8 corresponding to specific operating conditions. For example, the present inventors have identified that discharging the exhaust gas between the forward propeller 7 and the aftward propeller 8 provides a beneficial compromise of aeration in that one of the propulsors 6 may be aerated without necessarily aerating both. Furthermore, by discharging the exhaust gas between the forward propeller 7 and the aftward propeller 8 provides the same aeration whether the marine drive 1 is operated in a forward gear or a reverse gear.

The inventors have further identified that by discharging the exhaust gas through the lower surface 22 of the anti-cavitation plate 20 aft of the aftward propeller 8, neither the forward propeller 7 nor the aftward propeller 8 is aerated, which is desirable when the marine drive 1 is operated in a forward gear and cruising. In one embodiment, the control module 90 causes exhaust gas to be discharged to aerate both the forward propeller 7 and the aftward propeller 8 during acceleration in forward gear, but causes the exhaust gas to discharge aft of the aftward propeller 8 (causing no aeration) upon reaching a cruising speed. The control module 90 may also cause the exhaust gas to discharge in intermediate positions, such as discharging between the forward propeller 7 and the aftward propeller 8 during some portion of the acceleration before cruising.

The present inventors have also identified that discharging the exhaust gas through the strut 30 and the lower surface 22 of the anti-cavitation plate 20 forward of the forward propeller 7 is advantageous for reverse thrust. The typical exhaust configurations known in the art principally discharge the exhaust through the hub opening 56. While generating reverse thrust, this discharged exhaust gas is sucked into the flow field that passes over the blades of the propulsors 6, effectively limiting the amount of water that the propulsors 6 have access to grab. This problem is commonly referred to as "prop venting". By discharging at least a portion of the exhaust gas forward of the forward propeller 7 while operating the marine drive 1 in reverse gear, this portion of exhaust gas does not enter the flow field to create the unintended prop venting.

In accordance with the previous discussion, the disclosure further relates to a method of operating a marine drive 1 having an internal combustion engine 3 that rotates a propulsor shaft 60 that is operatively coupled to a propulsor (such as the forward propeller 7 and/or the aftward propeller 8) to impart a propulsive force in water. The method includes controlling the flow of exhaust gas from the internal combustion engine 3 via an exhaust outlet in the upper portion 12 of the gearcase housing 10, whereby the upper portion 12 is positioned above a lower portion 14 of the gearcase housing 10 and the lower portion 14 supports the propulsor shaft 60. The exhaust outlets are configured to discharge the exhaust gas from the exhaust passage 40, which may be in communication with an upper passage 42 and/or a lower passage 44 to discharge the exhaust gas into the water. The exhaust outlets, which in the embodiments previously discussed include strut openings 53*a-c* and plate openings 55*a-f* face the propulsors 6 so that the exhaust gas is discharged towards the propulsors 6 so as to aerate the water encountered by the propulsors 6.

The method further comprises controlling a control valve, such as the strut control valve 72 and/or the plate control valve 74 in positions into and between an open position wherein the exhaust is allowed to pass through at least one of the plurality of openings (such as the strut openings 53*a-c* and/or the plate openings 55*a-f*) and a closed position wherein the exhaust gas is prevented from passing through the at least one of the plurality of openings (strut openings 53*a-c* and/or plate openings 55*a-f*). It is further anticipated by the presently disclosed method that in addition to being in an open position and a closed position, the plurality of openings may be in a partially-open position.

As previously discussed, the control valves may either be active or passive. As a passive valve, the plurality of openings may be statically open, or may be actuated by a pressure differential between the exhaust passage and the water. Furthermore, the method further comprises controlling the flow of exhaust gas through the plurality of openings (including the strut openings 53*a-c* and/or plate openings 55*a-f*) based upon an operating position of the marine drive 1. Operating conditions may include operating in a forward gear, a reverse gear, or a neutral position. Likewise, the operating condition of the marine drive includes an acceleration state, whereby the marine drive 1 may be accelerating, decelerating, or maintaining a consistent cruising speed. In practicing the disclosed method, the upper portion 12 of the gearcase housing 10 will in some embodiments further comprise a vertically extending strut 30 with a trailing edge 32, and an anti-cavitation plate 20 horizontally extending from the strut 30. The anti-cavitation plate 20 has a lower surface 22 that defines the plate openings 55*a-f*. Likewise, the trailing edge 32 of the strut 30 defines the strut openings 53*a-c*. It should be recognized that greater or fewer openings may be defined by the strut 30 or the anti-cavitation plate 20 in accordance with the present disclosure.

Through experimentation and development, the present inventors have identified that the presently disclosed marine drive 1 and methods provide optimal performance of both acceleration and top speed for a given internal combustion engine 3 and boat application. Consequently, the disclosed marine drive 1 and methods allow the boat to get on plane faster and also provide improved fuel economy through optimized performance.

What is claimed is:

1. A method of operating a marine drive having an internal combustion engine that rotates a propeller to impart a propulsive thrust in water, the marine drive having a gearcase housing with a generally vertically extending strut located forwardly of the propeller and a lower surface that extends rearwardly of the strut and above the propeller, the method comprising actively controlling a first flow of exhaust gas into the water adjacent the propeller via the lower surface and actively controlling a second flow of exhaust gas from the internal combustion engine into the water adjacent the propeller via the strut, wherein the first and second flows of exhaust gas are actively controlled based upon a current operating condition of the marine drive.

2. The method according to claim 1, further comprising opening the second flow of exhaust gas when the marine drive is operated in a forward gear.

3. The method according to claim 1, wherein the second flow of exhaust gas is open when the marine drive is accelerating and wherein the second flow of exhaust gas is closed when the marine drive is operated at a cruising speed.

4. The method according to claim 1, wherein the first flow of exhaust gas is open when the marine drive is accelerating and wherein the first flow of exhaust gas is closed when the marine drive is operated at a cruising speed.

5. The method according to claim 1, wherein the first and second flows of exhaust gas are open when the marine drive is accelerating and wherein the first and second flows of exhaust gas are closed when the marine drive is operated in forward gear at a cruising speed.

6. The method according to claim 1, wherein the propeller is one of forward and aftward propellers.

7. The method according to claim 6, wherein the first flow of exhaust gas is discharged only between the forward and aftward propellers when the marine drive is operated in forward or reverse gear.

8. The method according to claim 6, wherein the first flow of exhaust gas is discharged only aftward of the aftward propeller when the marine drive is operated in forward gear at a cruising speed.

9. The method according to claim 6, wherein the first flow of exhaust gas is discharged into the water adjacent the forward and aftward propellers when the marine drive is accelerating in forward gear, and thereafter wherein the first flow of exhaust gas is discharged only aftward of the aftward propeller when the marine drive is operated in forward gear at a cruising speed.

10. The method according to claim 6, wherein the first flow of exhaust gas is only discharged into the water between the forward and aftward propellers when the marine drive is accelerating in forward gear, and thereafter wherein the first flow of exhaust gas is discharged only aftward of the aftward propeller when the marine drive is operated in forward gear at a cruising speed.

11. The method according to claim 9, wherein the first flow of exhaust gas is discharged only into the water forward of the forward propeller when the marine drive is operated in reverse gear.

12. The method according to claim 1, further comprising operating at least one control valve to actively control the first and second flows of exhaust gas.

13. The method according to claim 1, further comprising actively varying a location of the first flow of exhaust gas along the lower surface depending upon a current operational condition of the marine drive.

14. A method of operating a marine drive having an internal combustion engine that rotates a propeller to impart a propulsive thrust in water, the marine drive having a gearcase housing with a generally vertically extending strut located forwardly of the propeller and a lower surface that extends rearwardly of the strut and above the propeller, the method comprising actively controlling a flow of exhaust gas into the water adjacent the propeller via the lower surface based upon a current operating condition of the marine drive, and further comprising actively varying a location of the flow of exhaust gas along the lower surface depending upon a current operational condition of the marine drive.

15. The method according to claim 14, wherein the flow of exhaust gas is discharged only between the forward and aftward propellers when the marine drive is operated in forward or reverse gear.

16. The method according to claim 14, wherein the flow of exhaust gas is discharged only aftward of the aftward propeller when the marine drive is operated in forward gear at a cruising speed.

17. The method according to claim 14, wherein the flow of exhaust gas is discharged into the water adjacent the forward and aftward propellers when the marine drive is accelerating in forward gear, and thereafter wherein the flow of exhaust gas is discharged only aftward of the aftward propeller when the marine drive is operated in forward gear at a cruising speed.

18. The method according to claim 14, wherein the flow of exhaust gas is only discharged into the water between the forward and aftward propellers when the marine drive is accelerating in forward gear, and thereafter wherein the flow of exhaust gas is discharged only aftward of the aftward propeller when the marine drive is operated in forward gear at a cruising speed.

19. The method according to claim 14, wherein the flow of exhaust gas is discharged only into the water forward of the forward propeller when the marine drive is operated in reverse gear.

20. The method according to claim 14, further comprising operating at least one control valve to actively control the flow of exhaust gas.

* * * * *